US005425465A

United States Patent [19]

Healy

[11] Patent Number: 5,425,465

[45] **Date of Patent: * Jun. 20, 1995**

[54] VALVED MEDICATION CONTAINER

[76] Inventor: Patrick M. Healy, 401 N. Roosevelt, Wichita, Kans. 67208

[ * ] Notice: The portion of the term of this patent subsequent to Mar. 3, 2009 has been disclaimed.

[21] Appl. No.: 25,990

[22] Filed: Mar. 3, 1993

[51] Int. Cl.[6] ..... B65D 39/00

[52] U.S. Cl. ..... 215/355; 215/247; 215/364; 215/DIG. 3; 604/91; 141/329; 141/352

[58] Field of Search ..... 215/247, 257, 355, 358, 215/363, 364, DIG. 3; 220/229, 265, 277; 604/89, 91, 167, 169, 415, 416, 256; 141/329, 352, 354

[56] References Cited

U.S. PATENT DOCUMENTS

| | | | |
|---|---|---|---|
| 2,289,677 | 7/1942 | Perelson | 215/247 |
| 2,326,490 | 8/1943 | Perelson | 215/247 |
| 3,940,003 | 2/1976 | Larson | 215/247 |
| 3,977,555 | 8/1976 | Larson | 215/247 |
| 4,493,348 | 1/1985 | Lemmons | 604/91 X |
| 4,700,861 | 10/1987 | Neward | 215/309 |
| 4,917,668 | 4/1990 | Haindl | 604/167 |
| 5,062,836 | 11/1991 | Wendell | 604/167 |
| 5,092,840 | 3/1992 | Healy | 604/83 |
| 5,137,527 | 8/1992 | Miller et al. | 604/415 |
| 5,269,771 | 12/1993 | Thomas et al. | 604/213 |

OTHER PUBLICATIONS

Jagger, J. and E. Hunt, R. Pearson; "Estimated Cost of Needlestick Injuries for Six Major Needled Devices"; *Infection Control*..., vol. 11, No. 11, pp. 584–588, 1990.

Hanan, Z.; "The Pharmacist's Role in Controlling Bloodborne Infections With Emphasis on Providing Safe Injection Systems"; *Infection Control Hosp. Epidermal;* vol. 11, No. 10, pp. 566–568, 1990.

"FDA Releases Alerton IV Needlesticks"; *The American Nurse,* Sep. 1992.

*Primary Examiner*—Allan N. Shoap
*Assistant Examiner*—Vanessa Caretto
*Attorney, Agent, or Firm*—Richard K. Thompson

[57] ABSTRACT

A valved medication container for facilitating needleless transfer of medication from the container to a patient. Four embodiments of valve members are disclosed. The first embodiment employs a slidable actuator which is engaged by the nose portion of a syringe and deflected into the container through a slit elastomeric membrane. A second embodiment employs a duckbill which the nose of the syringe biases to an open position. The third embodiment uses axially opposed flapper valves which the nose of the syringe pushes open. The fourth embodiment employs a slidable actuator with a T-shaped passageway which is moved to the open position by the syringe. A vent having a one-way valve for influx of air is provided for larger containers.

20 Claims, 4 Drawing Sheets

VALVED MEDICATION CONTAINER

FIELD OF THE INVENTION

The present invention is directed to the field of valved medication containers. More specifically, the present invention is directed to improved valve configurations for use in the medication container described and claimed in U.S. Pat. No. 5,092,840.

BACKGROUND AND SUMMARY OF THE INVENTION

Recent articles in medical journals demonstrate the hidden costs of using needles to administer medication to patients, and the like. One article reports that fully one third of all work-related hospital accidents relate to needlesticks. Needle stick injuries have a potential devastating long term impact on hospital workers with the increasing risks of blood-borne disease transmission, particularly diseases such as human immunodeficiency virus (HIV) and hepatitis B. That same article reports needle stick injury rates in excess of one per ten employees. A second article determined the average cost (not including costs associated with employee loss due to debilitating injury) to be $405 per injury. These costs are in addition to the known costs associated with the purchase and disposal of the needled devices.

A third article reports the hospital handling of needles leading to needle stick injuries as being 1) intramuscular or subcutaneous injections,
2) intravenous catheters,
3) disassembly of the needled devices,
4) recapping attempts,
5) multistep procedures (e.g., multi-component medication mixing),
6) disposal of needles.

This same article reported that only 18% of the needle stick injuries involved in this study could be addressed by an improved disposal technique and concluded that only a portion of those 18% could be eliminated by such improved handling techniques. This article suggests the answer lies in eliminating the unnecessary use of needled devices, that is, usage of needleless and protected needle devices is encouraged.

The risks associated with using needles and the advantages of needleless transfer systems for medication are further detailed in U.S. Pat. No. 5,092,840, which is hereby incorporated by reference. The significant reduction of the risk of transmitting blood-borne diseases make the use of such a needleless system very attractive. Still, it is important that the valved medication container be workable without exacting a substantial penalty in the area of cost. To this end, the present invention presents a number of workable, cost-effective valved medication containers.

Other proposed solutions have included the use of an adapter that can be threadably attached to the top of the container to permit engagement by a syringe. One of the problems with a separate attachable adapter is that it requires the extra steps of locating and affixing the adapter. In addition, proper sanitation requires the adapter to be sterilized before each use to avoid possible contamination of the medication within the container.

Applicant's medication container includes a stopper with a self-contained valve that is engaged and operated by the blunt end of a needleless syringe. A first embodiment includes a sliding operator which engages a slit elastomeric membrane to force open a passageway that permits medication to be withdrawn. A second embodiment utilizes a double-biased duckbill curved inwardly where the blunt end of a syringe can engage and force the duckbill open against the bias. A third embodiment utilizes a T-shaped passageway in a sliding operator actuated by the syringe to move between a first closed position and a second open position. A fourth embodiment employs a pair of axially opposed flapper valves which define a slit at their junction that is opened by the leading end of the syringe. Each of these embodiments can be provided with an optional vent passage that may be equipped with a one-way valve to avoid medication leakage. The vent passageway becomes required in larger containers.

Various other features, advantages and characteristics of the present invention will become apparent after a reading of the following specification.

DETAILED DESCRIPTION OF THE PREFERRED EMBODIMENTS

Figure 1A:
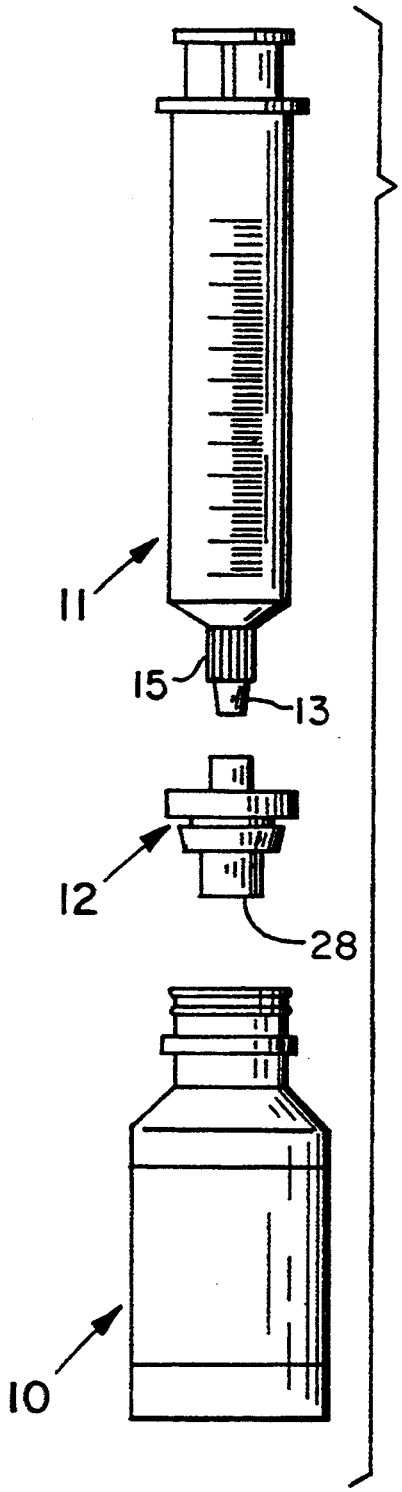
FIG. 1A is an exploded schematic showing three of the elements of the needleless transfer system of the present invention.
Figure 1B:
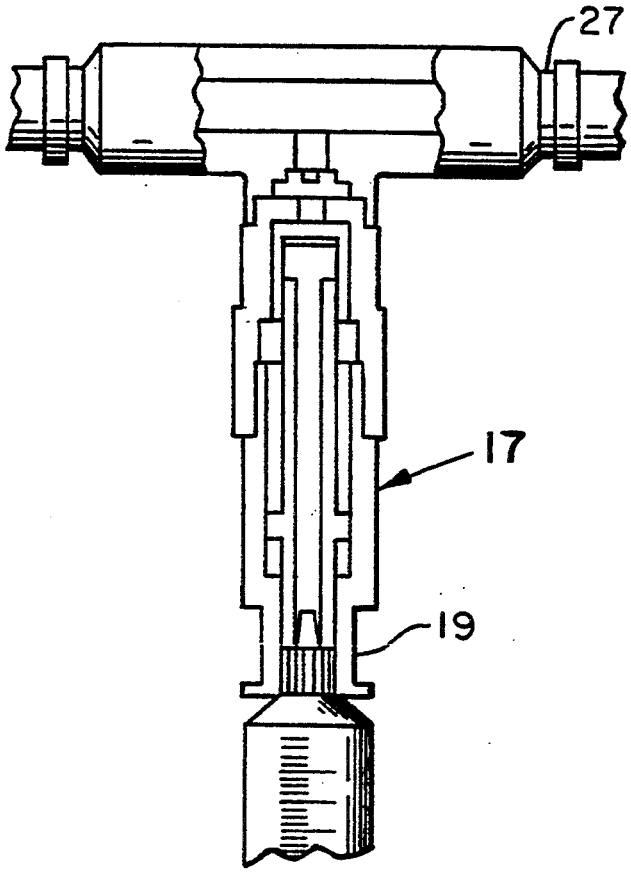
FIG. 1B is a side view in partial section depicting the needleless syringe of the present invention engaging the fourth element of the present needleless transfer system.

FIG. 1A depicts three elements of the needleless transfer system of the present invention, medication container 10, valved stopper 12, and needleless syringe 11, with the fourth element, injection port 17 connected to an IV tube 27, being shown in FIG. 1B. Valved stopper 12 has a member which has been designed to be engaged and actuated by blunt, tubular nose portion 13 of needleless syringe 11. FIG. 1 B depicts nose portion 13 with luer 15 being received within neck 19 of injection port 17. Although neck 19 could be designed to receive syringe 11 in this manner, luer 15 will more customarily fit outside the neck 19 for better sealing engagement, as depicted in FIGS. 2–5.

The key element of this needleless transfer system is the valved stopper 12. It is important that this component work effectively but be capable of being manufactured inexpensively. Health and safety of hospital workers is of vital importance, but if they come with too high a price tag, the resistance to change coupled with inertia maybe too great for a new system to overcome. Accordingly, the bulk of this description is directed to detailing the features and characteristics of several embodiments of valved stoppers 12.

A first embodiment of valved stopper 12 is shown in FIGS. 2A–E. This embodiment includes a first outer member 14 having a first portion 36 shaped to fit snugly within bottle 10 and flange 38 to overlie the mouth of container 10 and a second inner member 16 which contains the operative valve element 20. Preferably, the first outer member 14 is made of an elastomer and may be provided with a protruding ridge (not shown) to improve sealing within container 10 and the inner member 16 is made of a moldable plastic material. Inner member 16 is most preferably made of two portions 18 and 18' which may be bonded together, for ease of assembly. Valve assembly 20 includes actuator 22 slidably mounted within inner member 16 and an elastomeric membrane 24 whose outer periphery is fixed with respect to inner member 16 and has a slit 26 therethrough. Slit 26 is normally closed and, in the closed position, prevents egress of medication. Sliding of actuator 16 may be facilitated by a coating of Teflon polymer, or the like on one of the relatively slidable elements or by forming contact-reducing ribs on one of the contacting surfaces. Reducing the surface area in contact will result in reducing the frictional resistance to movement.

Figure 2A:
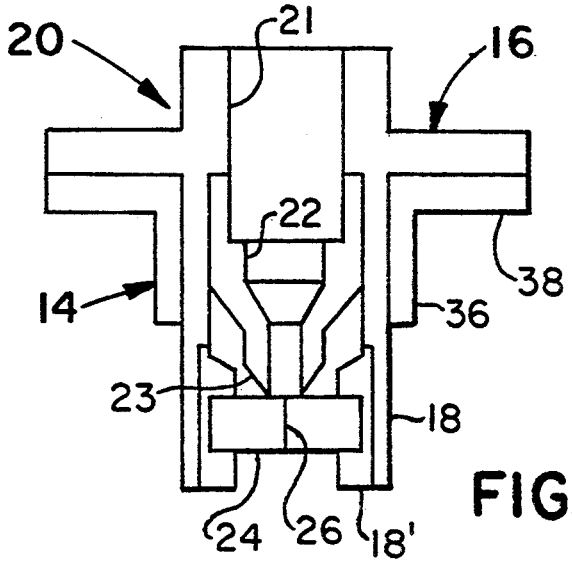
FIG. 2A is a cross-sectional side view of a first embodiment of a valve element of the present invention.
Figure 2B:
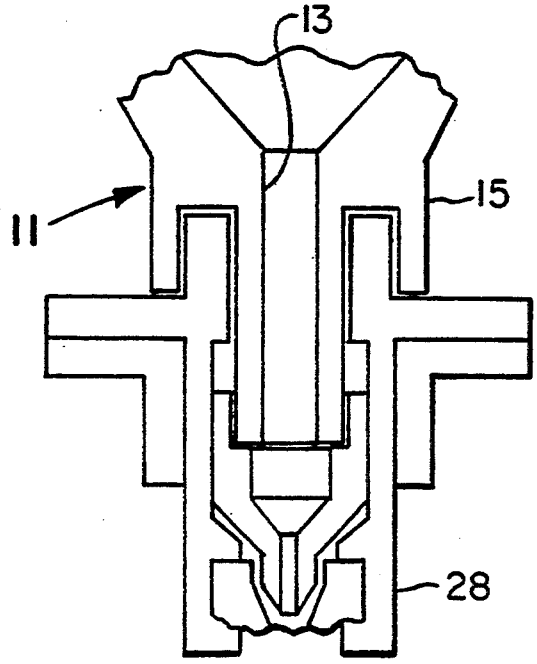
FIG. 2B is a cross-sectional side view of the first embodiment showing the valve element actuated by the nose of a syringe.
Figure 2C:
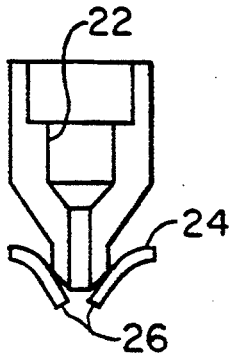
FIG. 2C is a cross-sectional side view of a variation of the first embodiment employing a thin membrane.
Figure 2D:
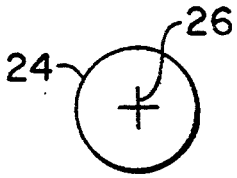
FIG. 2D is a top view of one opening configuration which may be used with the thin membrane of FIG. 2C.
Figure 2E:
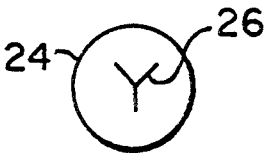
FIG. 2E is a top view of a second opening configuration which may be used with the thin membrane of FIG. 2C.

As shown in FIG. 2B, nose portion 13 is received in the trailing end 21 of actuator 22 and is advanced such that leading end 23 pushes through slit 26. In this embodiment, slit 26 is merely a short longitudinal cut through the thick membrane 24. Leading end 23 of actuator 22 causes the elastomer to bulge as it forces its way through. When syringe 11 has a proper dosage of medication, withdrawal of nose portion 13 from neck 19 of container 10 will provide a retraction force on actuator 22, which coupled with the restoring force of elastomeric membrane 24, will return actuator 22 to its at rest position (FIG. 2A). A variation of this embodiment is depicted in FIGS. 2C–E. In FIG. 2C, membrane 24 is relatively thin and can be deflected like a flap. For this variation, slit 26 preferably is configured like a crucifix (FIG. 2D) or as a Y (FIG. 2E) to facilitate the roll back of the elastomer.

Figure 3A:
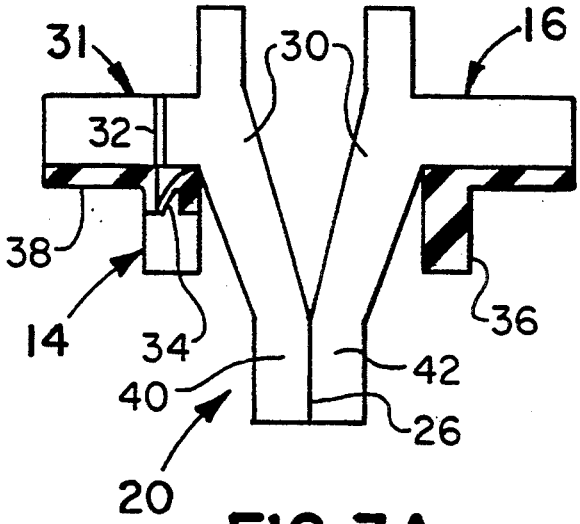
FIG. 3A is a cross-sectional side view of a second embodiment of the valve element of the present invention.
Figure 3B:
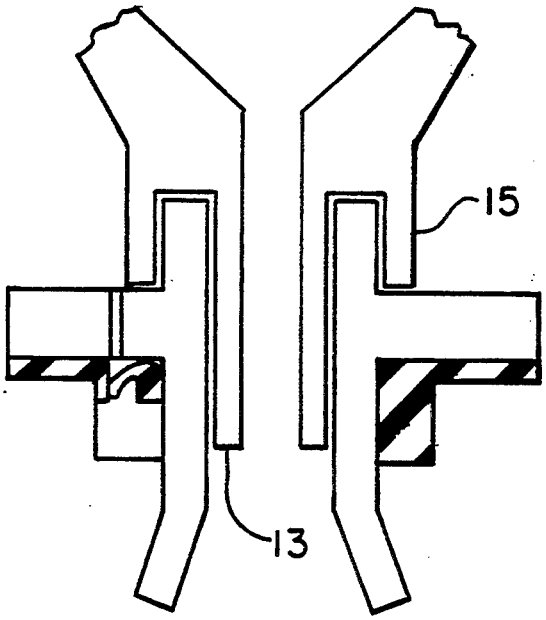
FIG. 3B is a cross-sectional side view of the second embodiment showing the valve element activated by a nose portion of a syringe.
Figure 3C:
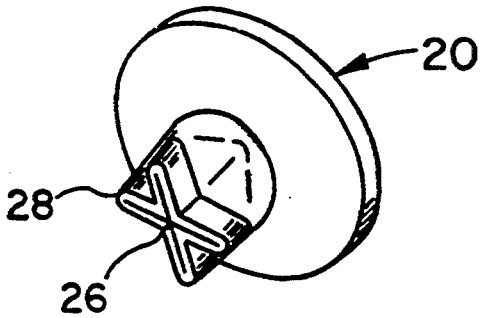
FIG. 3C is a perspective view of one form of the valve element of the second embodiment.

A second embodiment of valve member 20 is depicted in FIGS. 3A—C. In this embodiment, outer member 14 is made of a first elastomer while inner member 16 is made of a second elastomer. Alternatively, this stopper may be molded of a single plastic material having all the desired characteristics. Extension 28 may be configured as a double-biased duckbill having a first duckbill 40 biased inwardly and a second duckbill 42 biased inwardly as seen in FIG. 3A. Alternatively, as seen in FIG. 3C, extension 28 maybe configured as a crucifix. In either case, as shown in FIG. 3B, insertion of nose portion 13 of syringe 11 flexes the distal ends of extension 28 outwardly as walls 30 assume the round configuration of nose 13. This opens valve member 20 permitting medication to be withdrawn by syringe 11.

Also depicted in this embodiment is an air vent 31. Air vent 31 includes a hole 32 through inner member 16 and a molded flapper valve 34 formed in outer elastomeric member 14. Flapper valve 34 is a one-way valve which prevents medication from flowing out but permits the influx of air to aid in medication withdrawal by syringe 11. Such a feature will be required on the larger containers 10 to permit adequate insufflation for medication withdrawal. It should be noted that one of the benefits of the valved container 10 of the present invention is to make it possible to provide multiple-dose containers which can significantly reduce the per administration cost of medication to the patient.

Figure 4A:
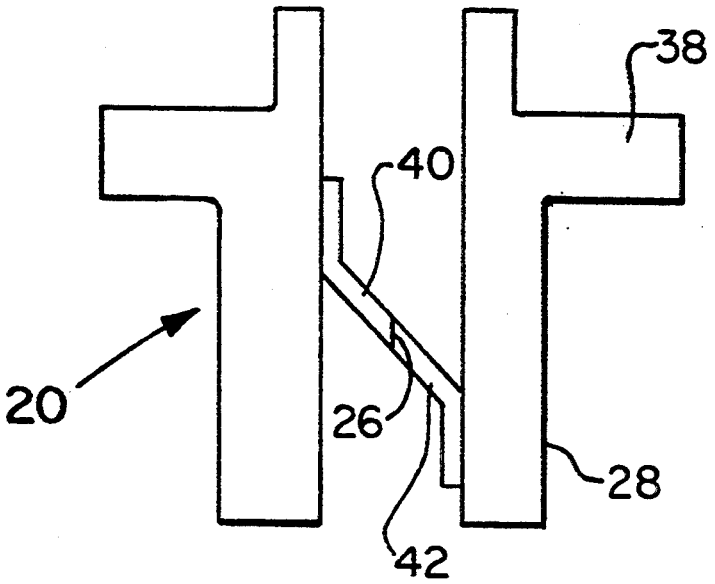
FIG. 4A is a cross-sectional side view of a third embodiment of the valve element employed in this invention.
Figure 4B:
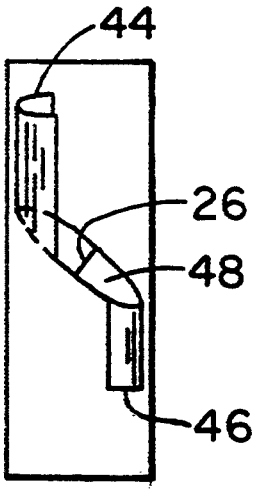
FIG. 4B is a cylindrical projection of a first configuration of the third embodiment of the present invention.
Figure 4C:
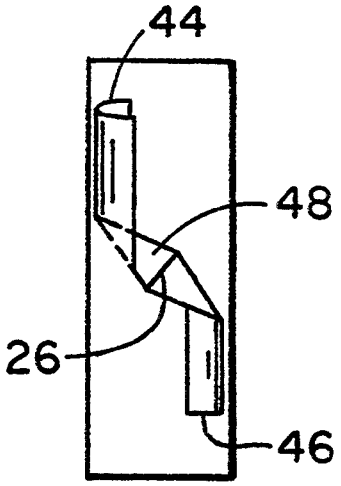
FIG. 4C is a cylindrical projection of a second configuration of the third embodiment of the present invention.

A third embodiment of valve member 20 of the present invention is shown in FIGS. 4A–C. In this embodiment, valve member 20 is formed as axially opposed flapper valves having a first flapper valve member 40 and an opposing second flapper valve 42. As seen in FIGS. 4B and 4C, first upper curved elastomer portion 44 intersects second lower curved elastomer portion 46 at an interconnecting fiat portion 48 which may, for example, be oval (FIG. 4B) or triangular (FIG. 4C) in shape. Slit 26 is formed in the middle of fiat portion 48. In operation, nose portion 13 of syringe 11 will engage flapper valve 40 and deflect it downward into container 10. When the syringe/container assembly is then turned upside down for insufflation and medication withdrawal, the suction pull of the retracting plunger and the weight of the medication will cause flapper valve 42 to deflect toward the syringe 11 further opening slit 26.

Figure 5:
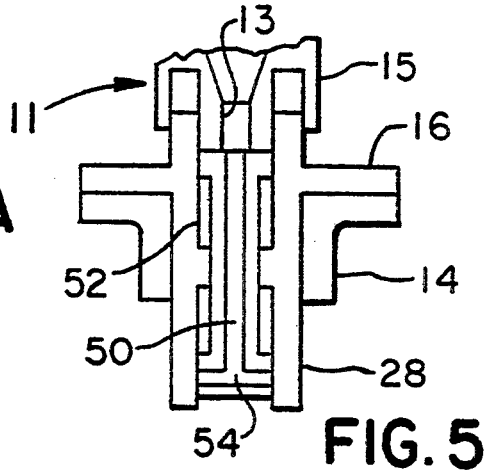
FIG. 5 is a cross-sectional side view of a fourth embodiment of the valve element of the present invention.

A fourth embodiment of the valve member 20 of the present invention is shown in FIG. 5. In this valve member, a generally I-shaped actuator 22 has a T-shaped passageway 50 formed therethrough. Spring element 52, depicted here as an elastomeric spring but could also be formed as a coil spring element, surrounds a portion of slidable actuator 22 to provide restorative force upon withdrawal of syringe 11. If spring element 52 is formed as an elastomeric spring, the annular elastomeric ring will either be thinner than the space it is occupying or the ring will have relief slots to provide space for the elastomer to occupy during bulging as actuator 22 collapses downwardly. Nose portion 13 of syringe 11 will move actuator 22 downwardly such that the lateral portion 54 of T-shaped passageway 50 is exposed to the inner confines of container 10 to permit medication to be withdrawn.

The four embodiments of valve element 20 discussed herein provide an inexpensive stopper 12 that can facilitate the use of a needleless syringe greatly reducing the risk of needle stick accidents. The few cents incremental costs for utilizing the valved stopper 12 of the present invention is well worth the investment in order to reduce the $405 per incident cost of needlesticks mentioned above, as well as the costs of purchasing and disposing of the needles themselves.

Various changes, alternatives and modifications will become apparent to a person of ordinary skill in the art following a reading of the foregoing specification. It is intended that all such changes, alternatives and modifications as fall within the scope of the appended claims be considered part of the present invention.

What is claimed is:

1. A valved medication container for use in a needleless medication transfer system including a needleless syringe having a blunt tubular nose end and an injection port in an intravenous tube, said valved medication container comprising:

a) a container having a neck portion;

b) a stopper seatable in said neck portion, said stopper including i) a longitudinally extending throughbore;

ii) a valve member positioned within said longitudinally extending throughbore, said valve member including an elastomeric member extending across said throughbore, said elastomeric member having a slit therethrough which has a first closed position and a second open position, c) actuator means comprising one of said blunt tubular nose end and an element of said stopper engageable with said slit to move said slit from its first closed position to its second open position permitting medication to be withdrawn from said container for transfer to said injection port.

2. The valved medication container of claim 1 wherein said stopper has a vent passage positioned outwardly from said longitudinally extending throughbore.

3. The valved medication container of claim 2 wherein said vent passage is equipped with a one-way valve allowing inward flow only.

4. The valved medication container according to claim 3 wherein said stopper has an annular section which fits within the neck portion of said container and said vent passage is situated in a truncated length of said annular section.

5. The valved medication container according to claim 1 wherein said valve member comprises a double-biased duckbill valve, said blunt end of said needleless syringe forming said actuator means and biasing, in said second position, said duckbill valve open.

6. The valved medication container of claim 1 wherein said valve member comprises a pair of axially opposed flapper valves, each of said pair of flapper valves having a first annular portion which conforms to an inner periphery of said container and a transition region, said two transition regions defining a laterally extending slit.

7. The valved medication container of claim 6 wherein said two transition regions generally form an ellipse.

8. The valved medication container of claim 6 wherein each of said two transition regions define triangular zones which share a common side which sides define said slit.

9. The valved medication container of claim 6 wherein each of said transition regions comprises a generally curved portion transitioning from said first annular portion to a portion adjacent said slit which is generally flat.

10. The valved medication container according to claim 1 wherein said actuator means comprises a slidable element contained within said stopper and slidable within a portion of said longitudinally extending throughbore.

11. The valved medication container according to claim 1 wherein said actuator means comprises a leading portion of said blunt tubular nose end which engages and deflects at least a first component of said elastomeric member to open said slit.

12. A valved medication container adapted to permit medication to be withdrawn from said container by a needleless syringe, said valved medication container comprising:

a) a container having a neck portion;

b) a stopper seatable in said neck portion, said stopper including i) a longitudinally extending throughbore;

ii) a valve member positioned within said longitudinally extending throughbore, said valve member including an elastomeric member extending across said throughbore, said elastomeric member having an opening therethrough which has a first closed position and a second open position, c) actuator means comprising one of said needleless syringe and an element of said stopper engageable with said opening to move said opening from its first closed position to its second open position permitting medication to be withdrawn from said container for transfer to said injection port.

13. The valved medication container of claim 12 wherein said stopper has a vent passage positioned outwardly from said longitudinally extending throughbore.

14. The valved medication container of claim 13 wherein said vent passage is equipped with a one-way valve allowing inward flow only.

15. The valved medication container according to claim 14 wherein said stopper has an annular section which fits within the neck portion of said container and said vent passage is situated in a truncated length of said annular section.

16. The valved medication container of claim 12 wherein said valve member comprises a double-biased duckbill valve, said blunt end of said needleless syringe biasing said duckbill valve open in said second position.

17. The valved medication container of claim 12 wherein said valve member comprises a pair of axially opposed flapper valves, each of said pair of flapper valves having a first annular portion which conforms to an inner periphery of said container and a transition region, said two transition regions defining a laterally extending slit.

18. The valved medication container of claim 17 wherein each of said transition regions comprises a generally curved portion transitioning from said first annular portion to a portion adjacent said slit which is generally flat.

19. The valved medication container according to claim 12 wherein said actuator means comprises a slidable element contained within said stopper and slidable within a portion of said longitudinally extending throughbore.

20. The valved medication container according to claim 12 wherein said actuator means comprises a leading portion including a tubular nose end which engages and deflects at least a first component of said elastomeric member to open said slit.

* * * * *